US012202697B2

(12) United States Patent
Capoia

(10) Patent No.: US 12,202,697 B2
(45) Date of Patent: Jan. 21, 2025

(54) SYSTEM AND METHOD FOR FORMING AND FANFOLDING A SHEET MATERIAL

(71) Applicant: INTERNATIONAL BOXES S.R.L., Cimadolmo (IT)

(72) Inventor: Giuseppe Capoia, Cimadolmo (IT)

(73) Assignee: ;Panotec S.r.l., Cimadolmo (IT)

( * ) Notice: Subject to any disclaimer, the term of this patent is extended or adjusted under 35 U.S.C. 154(b) by 0 days.

(21) Appl. No.: 18/035,730

(22) PCT Filed: May 19, 2022

(86) PCT No.: PCT/IB2022/054671
§ 371 (c)(1),
(2) Date: May 5, 2023

(87) PCT Pub. No.: WO2022/243923
PCT Pub. Date: Nov. 24, 2022

(65) Prior Publication Data

US 2024/0010458 A1 Jan. 11, 2024

(30) Foreign Application Priority Data

May 19, 2021 (IT) ..... 102021000012926

(51) Int. Cl.
*B65H 45/101* (2006.01)
*B65H 45/107* (2006.01)

(52) U.S. Cl.
CPC ..... *B65H 45/1015* (2013.01); *B65H 45/107* (2013.01); *B65H 2701/11231* (2013.01); *B65H 2701/1762* (2013.01)

(58) Field of Classification Search
CPC ..... B65H 45/107; B65H 45/1015; B65H 2701/176; B65H 2701/11231
See application file for complete search history.

(56) References Cited

U.S. PATENT DOCUMENTS 9,216,877 B2 12/2015 Grünwald et al.

FOREIGN PATENT DOCUMENTS

| | | | | |
|---|---|---|---|---|
| DE | 102012020943 | A1 | | 4/2014 |
| EP | 2409939 | A1 | | 1/2012 |
| IT | 1374280 | B1 | * | 11/2006 |
| JP | S4931775 | U | | 3/1974 |
| WO | 2013132325 | A1 | | 9/2013 |

* cited by examiner

*Primary Examiner* — Daniel Jeremy Leeds
(74) *Attorney, Agent, or Firm* — Themis Law

(57) ABSTRACT

A system for forming and fanfolding a sheet material, from a web of indefinite length, having a bottom, top and longitudinal side edges, the system includes a frame, a feeding device, a creasing device downstream of the feeding device to form transverse creases on the web spaced apart at a constant longitudinal pitch and defining adjacent partitions, and a folding device located downstream of the creasing device for folding adjacent partitions along creases into a fanfold arrangement. The folding device includes at least one first group of thrust tools acting on creases formed on the bottom side of the web and at least one second group of thrust tools acting on creases formed on the top side of the web. The thrust tools of each group are mechanically connected to and operatively dependent on each other so that tools of the same group are forced to follow the same trajectory.

15 Claims, 6 Drawing Sheets

SYSTEM AND METHOD FOR FORMING AND FANFOLDING A SHEET MATERIAL

FIELD OF THE INVENTION

The present invention generally finds application in the field of packaging and particularly relates to a system for forming and fanfolding a sheet material, such as corrugated cardboard.

The invention also relates to a method of forming and fanfolding a sheet material, such as corrugated cardboard.

BACKGROUND ART

Sheet materials, typically corrugated cardboard, have been long known to be used in box package production in the form of a web of sheet material that is folded into a fanfold arrangement to reduce bulk and facilitate handling.

In fact, the raw sheet material is initially provided as a continuous web, like the continuous forms of old dot-matrix printers, i.e., consisting of a continuous sheet material of indefinite length composed of a succession of adjacent partitions or sections of equal size, known as partitions, delimited by fold lines and alternately folded one on top of the other to form a stack of superimposed partitions.

The stacks of equal or different sizes are loaded into the magazines of an automatic or semi-automatic machine or plant for manufacturing boxes of desired sizes.

In order to obtain a stack, the continuous web initially undergoes a process of forming fold lines transverse to the longitudinal direction of the continuous web, normally by means of a creaser with at least two opposed pressing rollers for forming creases on the two sides of the continuous web that divide adjacent partitions.

Once the fold lines or creases have been formed, the web undergoes a fanfolding step, i.e., alternate folding of adjacent partitions one on top of the other, followed by a step of stacking in a final unloading unit and cutting to a desired or standard height.

Then, the fanfold stacks of sheet material are loaded into one or more storage magazines of a cutting and creasing machine from which the partitions are successively deployed and carried to feed the cutting and creasing units which will form single pieces (blankets) to be assembled into boxes.

DE102012020943 discloses an apparatus for folding and stacking a continuous web into flat partitions, which has a feeding device for feeding a strip of sheet and a number of support elements which are guided along an annular guide for supporting the strip at the fold lines.

Furthermore, the support elements have an individual actuation control and can be displaced perpendicular to the direction of feed of the continuous web. The continuous web has a horizontal orientation relative to the feed device.

One drawback of this known system is that the fold lines are formed on one side only of the strip and the support elements always support the strip from the bottom. This may cause the formation of press creases in the strip also due to continuous changes of the feeding speed of the support elements.

Furthermore, the support elements project in cantilever fashion and laterally retract laterally to slide out of the fold lines and at this time the feeding speed decreases, thereby strongly affecting the working speed of the entire device.

EP2409939 discloses a folding device equipped with a guided latch member for displacing a corrugated cardboard web at a fold. Further latch members are guided independently of the former latch member to carry along the corrugated cardboard web at another fold, which is arranged upstream of the former fold.

Also, a stacking device is arranged downstream of a folding device for stacking the corrugated cardboard web, which is folded along the folds to form stacks.

One drawback of this known folding device is that once again the latch members operate on the cardboard web on one side only at one every two fold lines and cannot avoid the formation of press creases in the vicinity of the first latch member. Furthermore, the feeding speed is limited by the complexity of the mechanism for moving the independent latch members elements, which are driven by annular belts or chains.

A further drawback is that each time the stack has to be cut, the feeding speed of the continuous web decreases to allow the partition to be cut higher than the stack.

Technical Problem

In the light of the prior art, the technical problem addressed by the present invention consists in preventing the formation of press creases on the continuous web, while increasing the folding and stacking speed of the system.

DISCLOSURE OF THE INVENTION

The object of the present invention is to solve the above discussed problem, by providing a system and a method for forming and fanfolding a sheet material, such as corrugated cardboard, from a continuous web of indefinite length that are highly efficient and cost-effective.

A particular object of the present invention is to provide a system as discussed above that can minimize the formation of press creases near the fold lines while keeping the partitions of the continuous web flat and undeformed.

Another object of the present invention is to provide a system as discussed above that can guide the continuous web at high speed.

A further object of the present invention is to provide a system as discussed above that can be easily adapted to continuous webs of different widths without changing or replacing the folding tools.

These and other objects, as more clearly explained hereafter, are fulfilled by a system for forming and fanfolding a sheet material, such as corrugated cardboard, from a continuous web of indefinite length having a bottom side, a top side and longitudinal side edges, as defined in claim 1.

The system comprises a frame defining a vertical center plane, a feeding device having means for guiding the continuous web in a longitudinal direction, a creasing device located downstream of the feeding device to form transverse creases on the continuous web, spaced apart at a constant longitudinal pitch and defining adjacent partitions, and a folding device located downstream of the creasing device to progressively and alternately fanfold adjacent partitions along the creases.

According to a peculiar aspect of the invention, the folding device comprises at least one first group of thrust tools acting on the creases formed on the bottom side of the continuous web and at least one second group of thrust tools acting on the creases formed on the top side of the continuous web, wherein the tools of each group are mechanically connected to and operably dependent on each other so that all the tools of the same group are forced to follow the same trajectory.

Since the thrust tools act on the fold lines from both sides of the continuous web, the latter is progressively guided and accompanied toward the fanfolding zone without leaving free unguided zones and is prevented from being folded in any undesired manner.

This arrangement allows alternate operation on successive fold lines alternately formed at the creases from opposite sides of the continuous web, to keep the adjacent partitions well laid and avoid the formation of press creases.

Conveniently, a first operating assembly for supporting the first group of tools and a second operating assembly, separate from but dependent on the first assembly, for supporting the second group of tools are mounted to the frame.

This allows coordinated handling of the thrust tools to act simultaneously on the opposite faces of the continuous web.

The invention also relates to a method of forming, fanfolding and stacking a sheet material, such as corrugated cardboard, according to the invention, as defined in claim 15.

Advantageous embodiments of the invention are as defined in the dependent claims.

BRIEF DESCRIPTION OF THE DRAWINGS

Further features and advantages of the invention will be more apparent from the detailed description of a system for forming and fanfolding a sheet material, such as corrugated cardboard, from a sheet material, such as corrugated cardboard, which is described as a non-limiting example with the help of the annexed drawings, in which.

DETAILED DESCRIPTION OF A PREFERRED EXEMPLARY EMBODIMENT

Particularly referring to the figures, there is shown a system, generally designated by numeral 1, for forming and fanfolding a sheet material, such as corrugated cardboard, from a continuous web M of indefinite length having a bottom side $S_1$, a top side $S_2$ and longitudinal side edges B.

As is known per se, the continuous web M is substantially longitudinal and comprises a predetermined maximum width E defined by the distance of the longitudinal side edges B.

Figure 1:
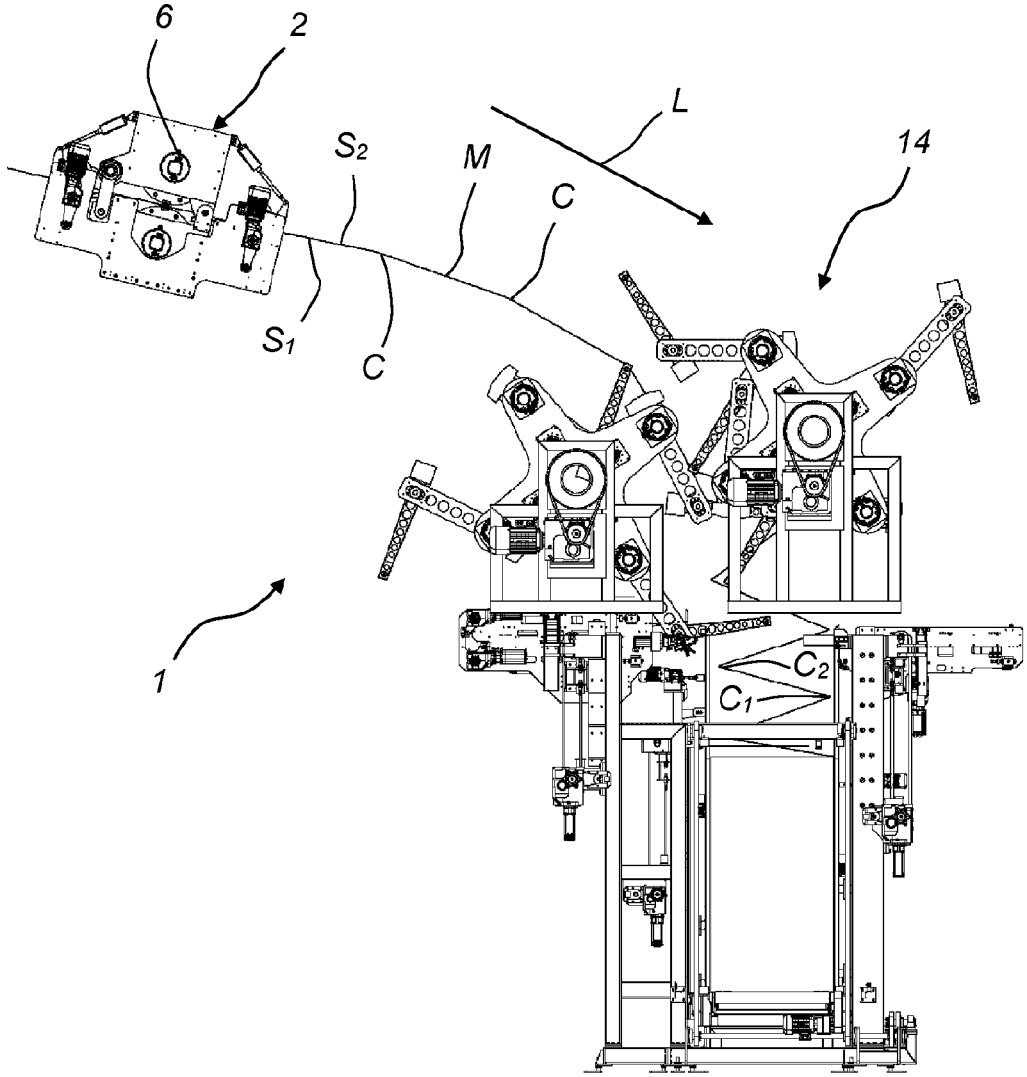
FIGS. 1, 2 and 3 are a side view, a top view and a perspective view of the system of the invention respectively.
Figure 2:
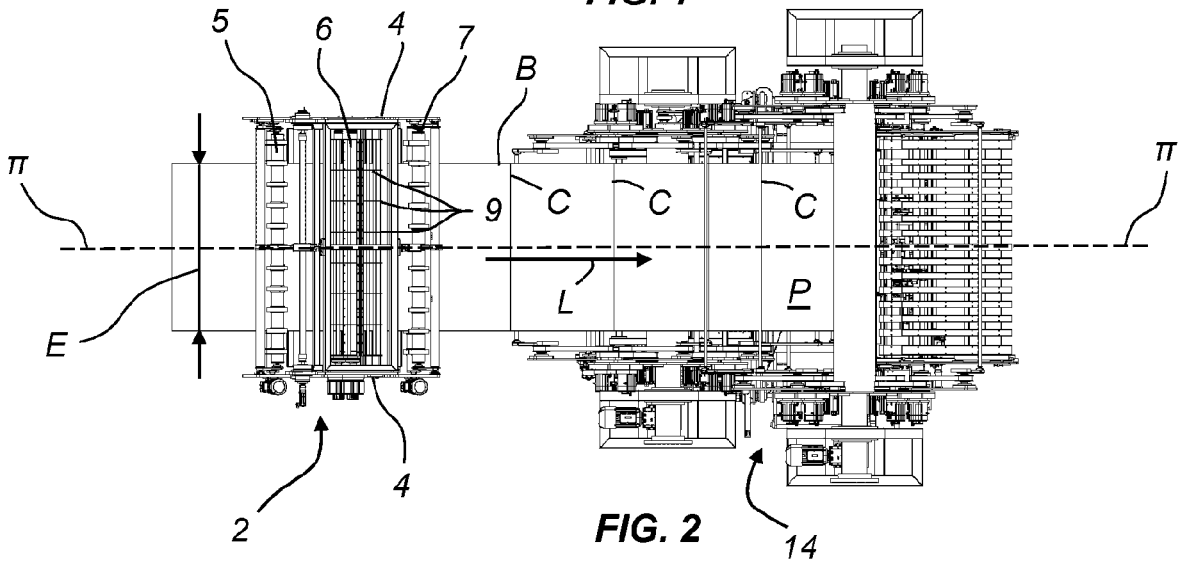
Figure 3:
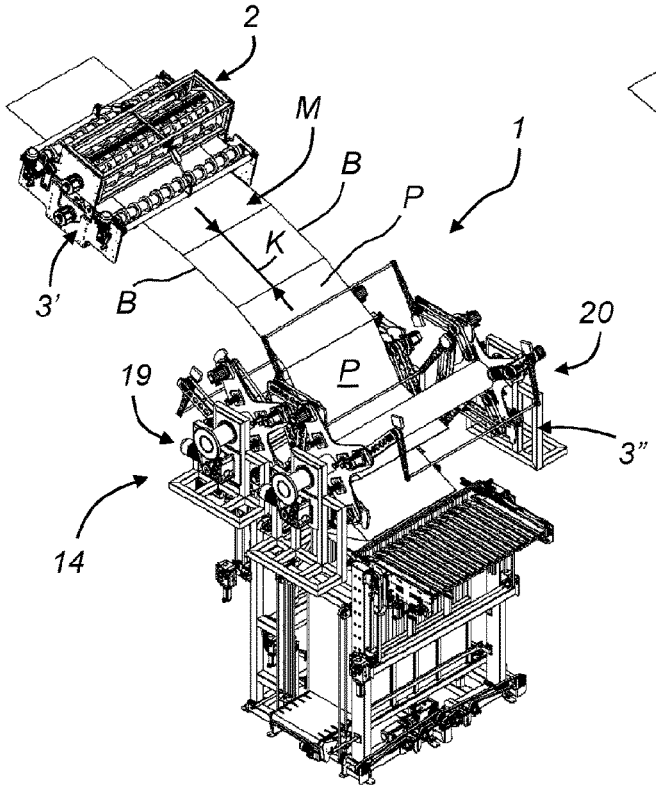
Figure 4:
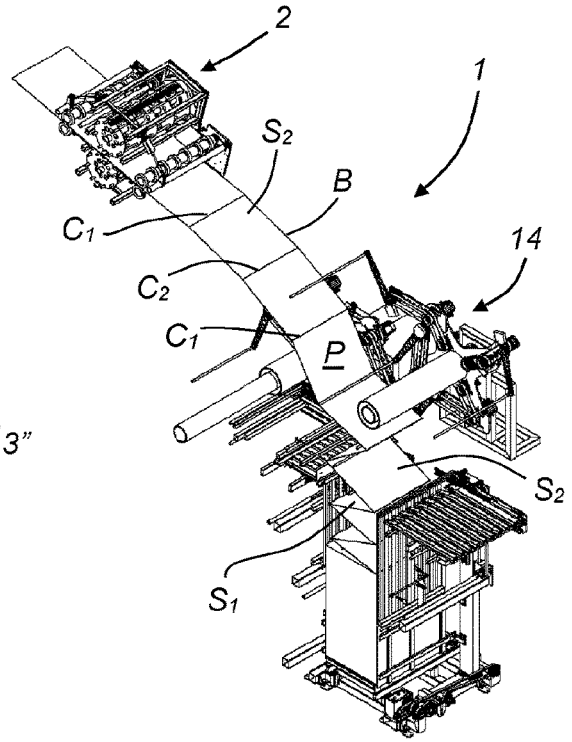
FIG. 4 is a cross-sectional view of the system of FIG. 3.

As best shown in FIG. 1, the system 1 comprises a frame defining a vertical center plane $\pi$ and a feeding device, not shown, having means for guiding the continuous web M along a longitudinal direction L parallel to the vertical center plane $\pi$.

A creasing device 2 is also provided downstream of the feeding device and is adapted to form transverse creases C on the continuous web M, spaced apart at a constant longitudinal pitch K and defining adjacent partitions P.

The creasing device 2 comprises a frame 3' having a pair of side walls 4 and adapted to support a first pair of no-crush wheels 5 for input of the web M from the feeding device, a pair of creasing rollers 6 and a second pair of no-crush wheels 7 for output of the web M after creasing.

Figure 5:
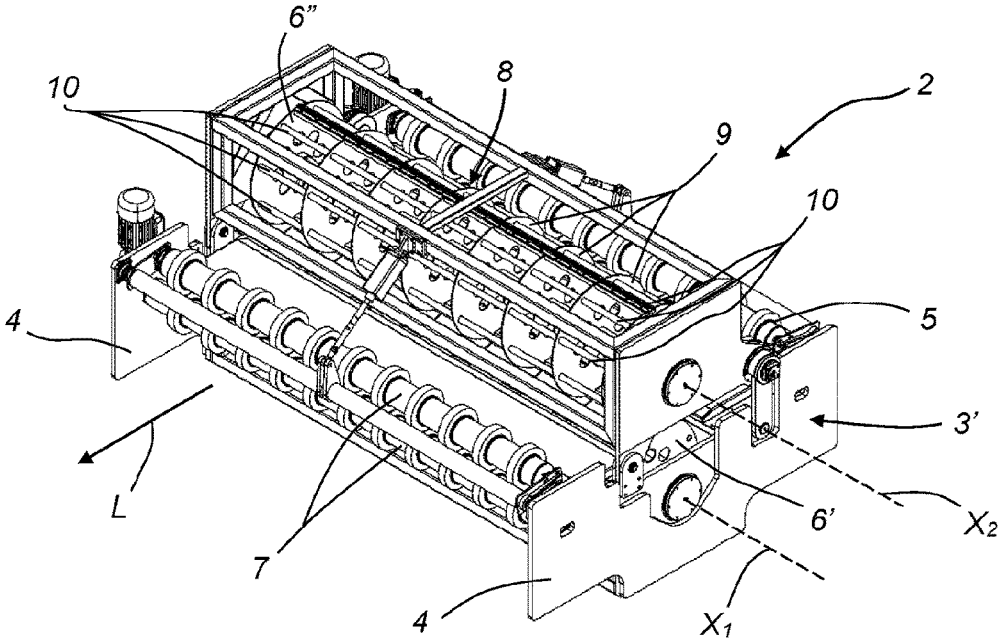
FIG. 5 is a perspective view of the creasing device of the system of FIG. 1.

As best shown in FIG. 5, the pair of creasing rollers 6 are motorized and comprise a lower roller 6' and an upper roller 6" rotating about their respective axes $X_1$, $X_2$ substantially parallel to each other and perpendicular to the longitudinal direction of feed L of the web M to be creased.

Advantageously, each creasing roller 6', 6" comprises a light-weight support frame 8 having a high bending resistance.

Figure 6:
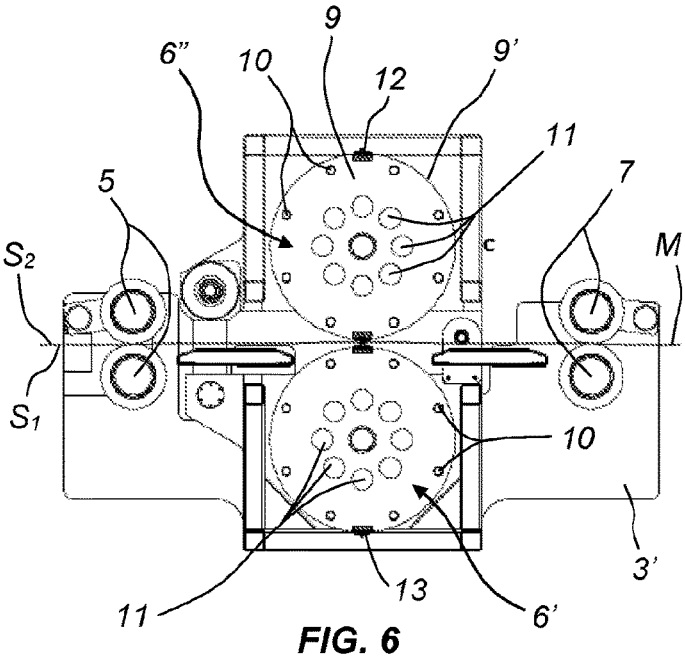
FIGS. 6 and 7 are a broken away side view of the creasing device of FIG. 5 and an enlarged view of a detail of FIG. 6 respectively.

In a preferred embodiment of the creasing device 2, the frame 8 comprises a plurality of disk-shaped elements 9 arranged at equally spaced axial positions and connected to each other by transverse rods or bars 10, parallel to the axis $X_1$, $X_2$ of each roller 6', 6" to stiffen the frame and counteract bending stresses, as best shown in FIG. 6.

Preferably, the disc-shaped elements 9 are made of sheet metal and have a circular peripheral edge 9' and a plurality of weight-reducing holes 11.

Advantageously, the creasing rollers 6', 6" are each equipped with a male tool 12 and a female tool 13 fixed transverse to the circular edge 9' of the disc-shaped elements 9 in diametrically opposite and perpendicular positions.

In other words, each creasing roller 6', 6" has a male tool 12 and a female tool 13 arranged at 180° and along the circular arc of the disk-shaped elements 9 substantially corresponding to the value of the longitudinal pitch K between the creases of the creased continuous web M.

Figure 7:
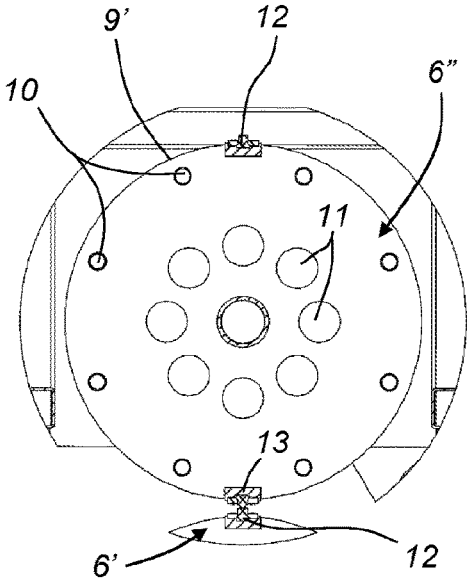

As best shown in FIG. 7, the male tool 12 of a creasing roller 6' is mounted in a position that is diametrically opposite and perpendicular to the female tool 13 of the other creasing roller 6".

Thus, the creasing device 2 is configured to form creases C alternately on the bottom side $S_1$ and on the top side $S_2$ of the continuous web M for forming "Z" folds.

Therefore, at the output of the creasing device 2, the web M will alternately and successively comprise a crease $C_1$ formed on the bottom side $S_1$, for folding the web M upwards, and a crease $C_2$ formed on the top side $S_2$, for folding the web M downwards.

It will be understood that the 180° mutual arrangement of the creasing tools 12, 13 allows the continuous web M to be processed at a constant angular speed.

Preferably, the tools 12, 13 are conveniently removable from their respective rollers 6', 6" for maintenance and/or replacement and tools of convenient shape may be installed, depending on the type of creasing desired and the type of sheet material to be processed.

Furthermore, the particular "open" structure, consisting of multiple disk-shaped elements 9 with the transverse rods or bars 10 mounted thereto and the "squirrel cage" structure of the creasing rollers 6', 6", has a very light weight and a high flexural strength due to the disk-shaped stiffeners in a direction parallel to the direction of feed of the continuous web M which limit transverse deformation.

This flexural strength ensures a substantially constant pressure along the axial extent of the creasing rollers 6', 6", thereby providing more uniform and consistent depth of the creases C and improved folding of the form M.

Conveniently, the system 1 comprises a folding device 14 located downstream of the creasing device 2 for progressively and alternately fanfolding adjacent partitions P along the creases C.

In a particular aspect of the invention, the folding device 14 comprises at least one first group of thrust tools 15 acting on the creases $C_1$ formed on the bottom side $S_1$ of the continuous web M and at least one second group of thrust tools 16 acting on the creases $C_2$ formed on the top side $S_2$ of the continuous web M.

Advantageously, the thrust tools 17, 18 of each group of tools 15, 16 are mechanically connected to and operatively dependent on each other so that all the tools 17, 18 of the same group will be forced to follow the same trajectory $T_1$, $T_2$.

Figure 8:
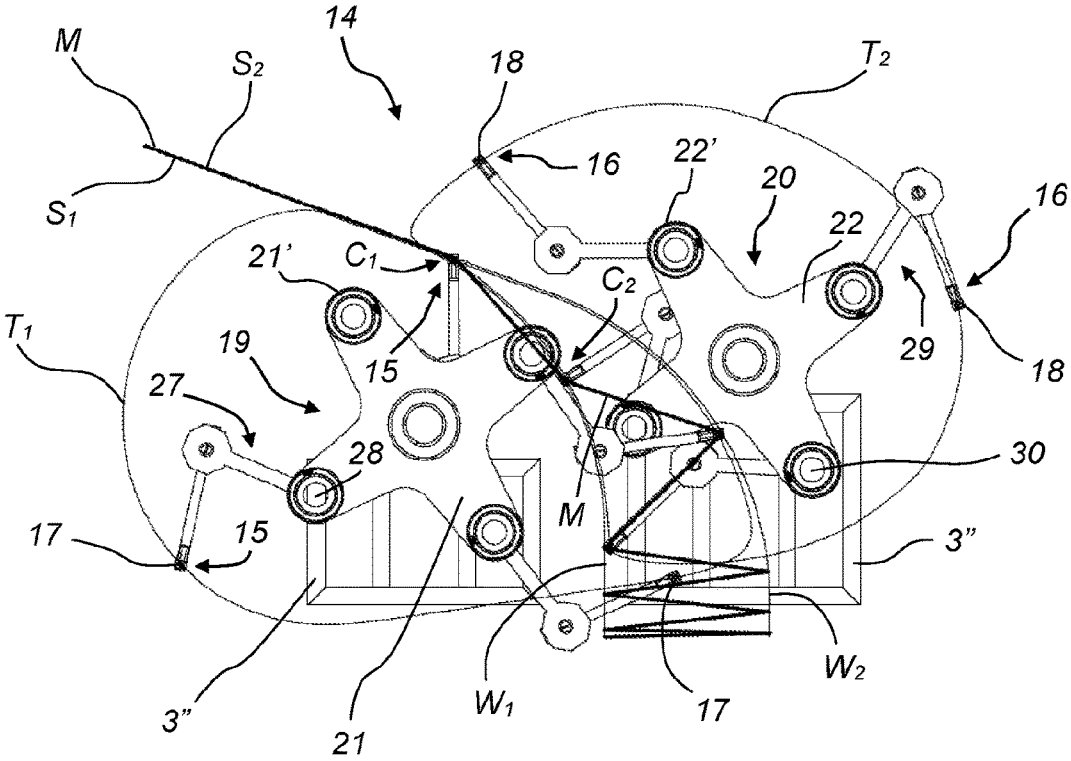
FIG. 8 is an enlarged side view of the folding device of the system of FIG. 1.

FIG. 8 shows a side view of the folding device 14 in which the trajectories $T_1$, $T_2$ of the first 15 and the second group 16 of thrust tools respectively are drawn as solid lines, and the continuous web M is temporarily folded to a "Z" shape by the two groups of thrust tools 15, 16, and having a development interposed between the two trajectories $T_1$, $T_2$.

Thus, the first group of tools 15 comprises first thrust tools 17 configured to temporarily push the creases $C_1$ formed on the bottom side $S_1$ of the continuous web M upwards, and the second group of tools 16 comprises second thrust tools 18 configured to temporarily push the creases $C_2$ formed on the top side $S_2$ of the continuous web M downwards.

As best shown in the figures, each thrust tool 17, 18 is a substantially horizontal elongate member, which is transverse and perpendicular to the center plane Tr.

It will be noted that the thrust tools 17, 18 alternately act on the creases $C_1$, $C_2$ and on the sides $S_1$, $S_2$ of the continuous web M, so that that the latter will be progressively guided and accompanied toward the fanfolding zone without leaving free unguided zones, and preventing it from being folded in any undesired manner.

In other words, the particular arrangement of the thrust tools 17, 18 and their respective groups of tools 15, 16 affords action on successive fold lines, alternately formed on the creases $C_1$, $C_2$ of the opposite sides $S_1$, $S_2$ of the continuous web M to keep adjacent partitions P well stretched and to avoid the formation of press creases.

Figure 9:
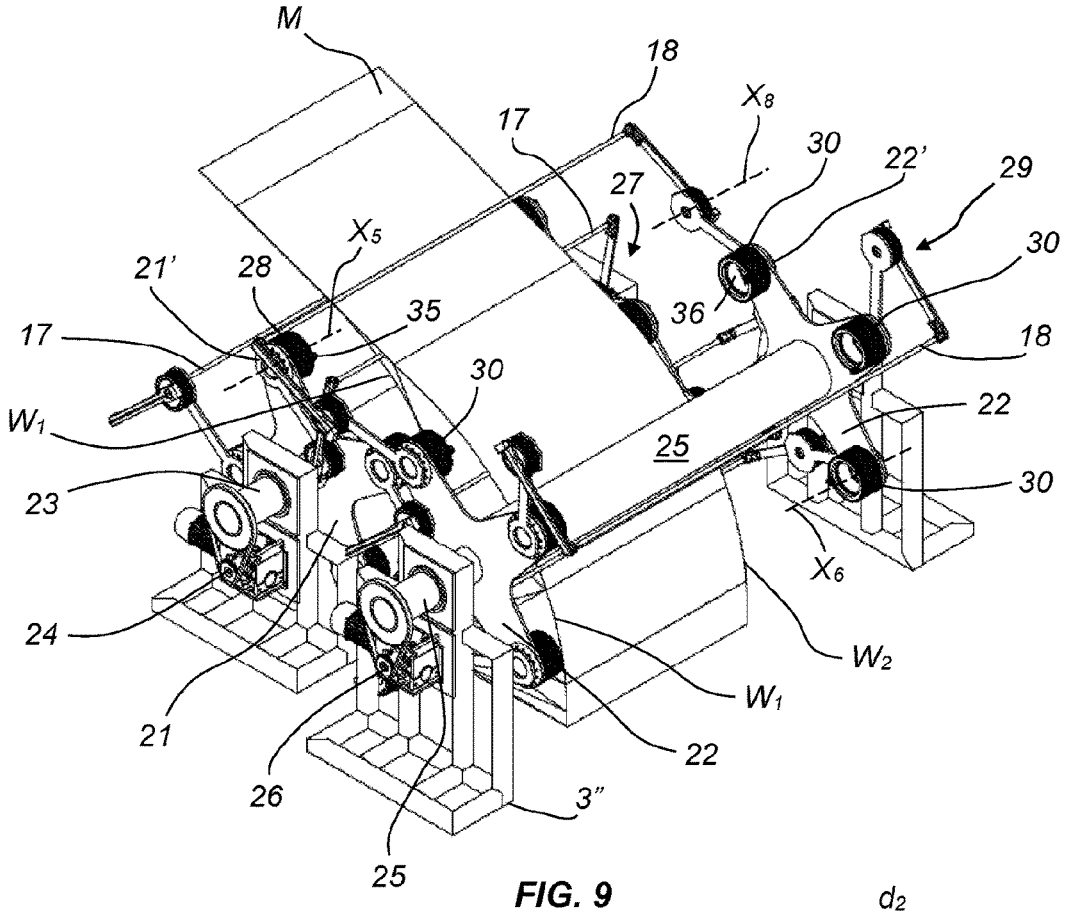
FIGS. 9, 10 and 11 are a perspective view, a top view and a front view of the device of FIG. 5 respectively.
Figure 10:
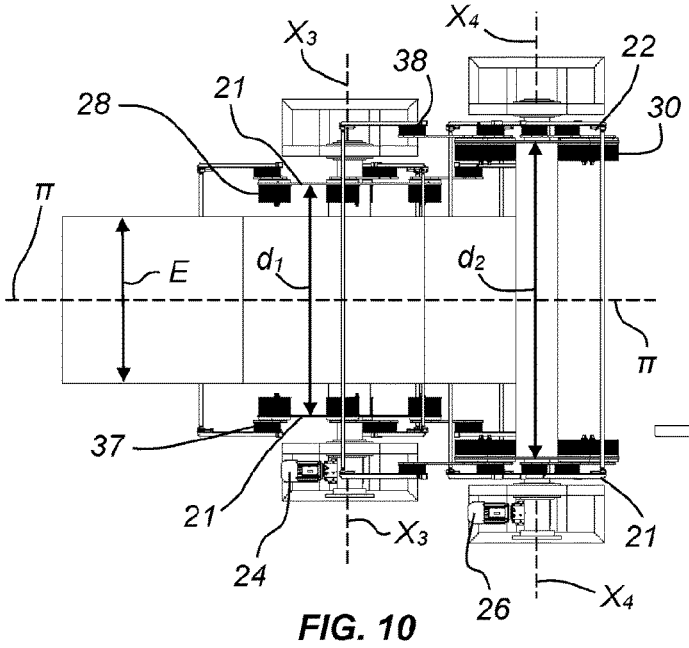
Figure 11:
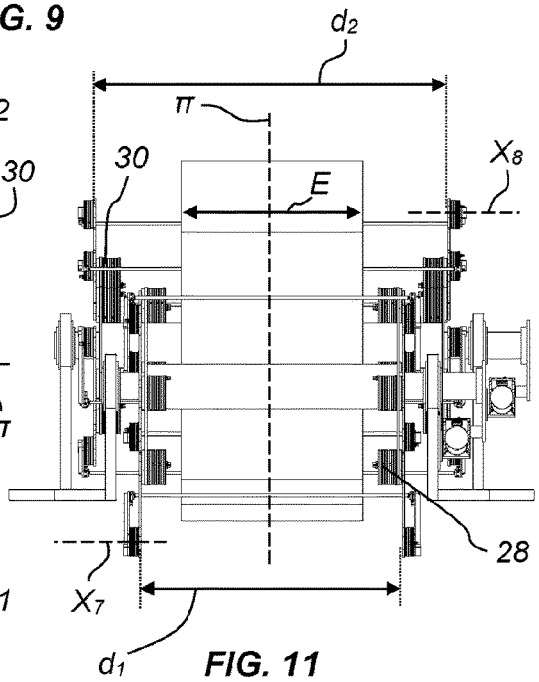
Figure 12:
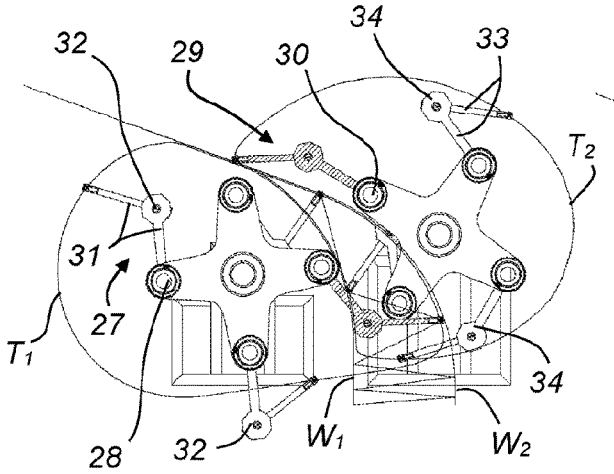
FIGS. 12 to 19 are side views of the device of FIG. 5 in different steps of operation.
Figure 13:
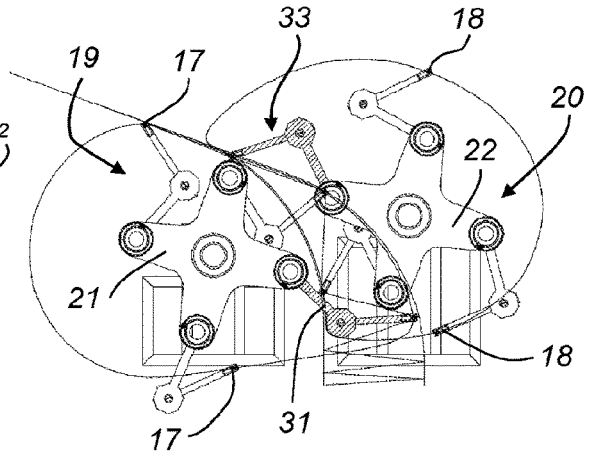

As more clearly shown in FIGS. 9 to 11, the folding device 14 comprises a frame 3" having mounted thereto a first operating assembly 19 for supporting a moving the first group 15 of thrust tools 17 and a second operating assembly 20, distinct from and independent of the first assembly 19, for supporting the second group 16 of thrust tools 18.

The first 19 and the second 20 operating assemblies respectively comprise, a first 21 and a second pairs 22 of supporting wheels, facing other about the vertical center plane π, and the supporting wheels of each pair 21, 22 are substantially vertical and symmetric about the center plane π.

As best shown in FIGS. 9-11, the supporting wheels of the first pair 21 are rigidly fixed to a first transverse shaft 23 driven by a first motor 24 and are located at a first transverse distance $d_1$ that is greater than the maximum width E of the continuous web M.

In addition, the supporting wheels of the second pair 22 are rigidly fixed to a second transverse shaft 25 driven by a second motor 26 and are located at a second transverse distance $d_2$ that is greater than the maximum width E of the continuous web M and greater than the first transverse distance $d_1$ Therefore, the first 21 and the second pairs 22 of supporting wheels are able to rotate along respective horizontal axes $X_3$, $X_4$ perpendicular to the center plane π and the first 23, and second transverse shafts 25 are concentric with the axis $X_3$. $X_4$ of each pair 21, 22 of supporting wheels.

Moreover, the first 23 and the second transverse shafts 25 are rotatably mounted to the frame 3" in longitudinally offset positions and with the second shaft 25 downstream of to the first shaft 23.

In the embodiment as shown in the figures, the supporting wheels of each pair 21, 22 substantially have a cross shape, with the transverse shafts 23, 25 extending from the center thereof.

However, this does not exclude that the supporting wheels of each pair 21, 22 may have a shape other from those as described heretofore.

Advantageously, the thrust tools 17, 18 of the same group 15, 16 are supported at the free ends of first series 27 and second series of articulated arms 28, as further described below As best shown in FIGS. 8 to 11, respective first series of articulated arms 27 are mounted near the peripheral edge 21' of the first pair of wheels 21, and are each driven by a respective first drive 28 whose transverse axis $X_5$ is perpendicular to the center plane Tr.

Likewise, respective second series of articulated arms 29 are mounted near the peripheral edge 22' of the second pair of wheels 22, and are each driven by a respective second drive 30 whose transverse axis $X_6$ is perpendicular to the center plane Tr.

The articulated arms of the first series 27 and the articulated arms of the second series 29 are in side-by-side relationship, and are directed radially outwards with respect to the respective pair of supporting wheels 21, 22 and constantly facing each other about the center plane π.

Advantageously, the articulated arms of the first series 27 are configured to support the first group of thrust tools 15 at their free ends and are formed by respective first pairs of elongate members 31 connected to each other by third drives 32 with transverse axes of oscillation $X_7$ perpendicular to the center plane π.

The articulated arms of the second series 29 are configured to support the second group of thrust tools 16 at their free ends and are formed by respective second pairs of elongate members 33 connected to each other by fourth drives 34 with transverse axes of oscillation $X_8$ perpendicular to center plane π.

Conveniently, the third 32 and fourth drives 34 are configured to impart a relative oscillation to the respective elongate members 31, 33 about the respective transverse axes of oscillation $X_7$, $X_8$.

It will be understood that each of the drives 28, 30, 32, 34 is operably coupled to the first 24 and the second motors 26 and is configured to keep the articulated arms of each series 27, 29 constantly paired and the thrust tools 17, 18 substantially parallel to each other and perpendicular to the longitudinal direction L.

In a first embodiment of the system 1, as shown in FIGS. 8 to 11, the first drive 28 and the second drive 30 comprise a third motor 35 and a fourth motor 36, respectively, and the third drives 32 and the fourth drives 34 comprise fifth motors 37 and sixth motors 38, respectively, in which the motors 35-38 are operably coupled to the first motor 24 and to the second motor 26.

In a second embodiment of the system 1, not shown in the figures, the first drive 28 and the second drive 30, the third drives 32 and the fourth drives 34 are of mechanical cam type and operably coupled to the first motor 24 and the second motor 26.

Cam-type mechanical actuators refer to mechanical members of chain, belt and gear types, for constraining motion to the first motor 24 and the second motor 26.

Of course, the first motor 24, the second motor 26 and the third, fourth, fifth and sixth motors 35-38 are controlled by a control unit, not shown, which is able to set the first and second differentiated and non-interfering trajectories $T_1$, $T_2$ to the first 15 and the second groups 16 of tools respectively.

Accordingly, the control unit is adapted to set the first and second paths $W_1$, $W_2$ respectively to the creases $C_1$, $C_2$ of the sides $S_1$, $S_2$.

As best shown in FIGS. 1 and 8, the first operating assembly 19 with the first pair of supporting wheels 21 is mounted to the frame 3" directly downstream of the creasing device 2, whereas the second operating assembly 20 with the second pair of supporting wheels 22 is mounted to the frame 3" downstream of and partially upwards with respect to the first operating assembly 19.

The relative position of the first 19 and the second operating assemblies 20 is determined in view of facilitating the alternating interaction on the creases $C_1$, $C_2$ with no mutual interference of the respective pairs of elongate members 31, 33 and the respective thrust tools 17, 18.

Thus, the creases $C_1$ of the bottom side $S_1$ are pushed by the thrust tools 17 first upwards and then toward the second group of tools 16, whereas the creases $C_2$ of the top side $S_2$ are pushed by the thrust tools 18 first downwards and then toward the first group of tools 15, as illustrated by the paths $W_1$, $W_2$ of the creases $C_1$, $C_2$ in FIG. 8.

This allows coordinated handling of the thrust tools 17, 18 to act simultaneously on the opposite sides $S_1$, $S_2$ of the continuous web M.

In FIGS. 12 to 19, one of the first pairs of elongate members 31 and one of the second pairs of elongate members 33 are shown respectively as dashed surfaces during operation of the folding device 14.

It will be appreciated herein that the continuous web M is constantly supported by at least four thrust tools 17, 18 and always at the respective creases $C_1$, $C_2$ to maintain the adjacent partitions P of the continuous web M flat and undeformed.

Thus, the thrust tools 17, 18 act on their respective creases $C_1$, $C_2$ on both sides $S_1$, $S_2$ of the continuous web M and the latter is progressively guided and accompanied toward the fanfolding zone without leaving free unguided zones and preventing any undesired folding thereof.

Figure 14:
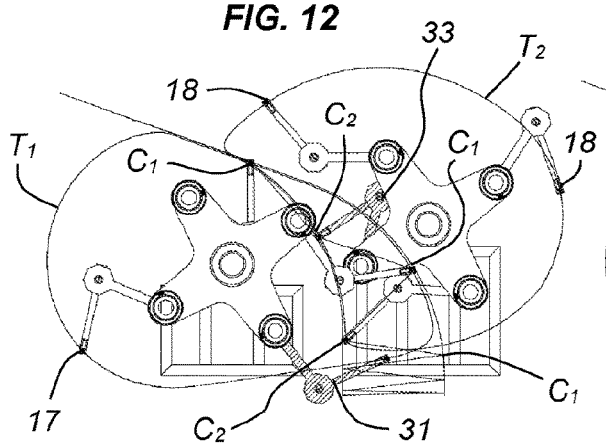
Figure 15:
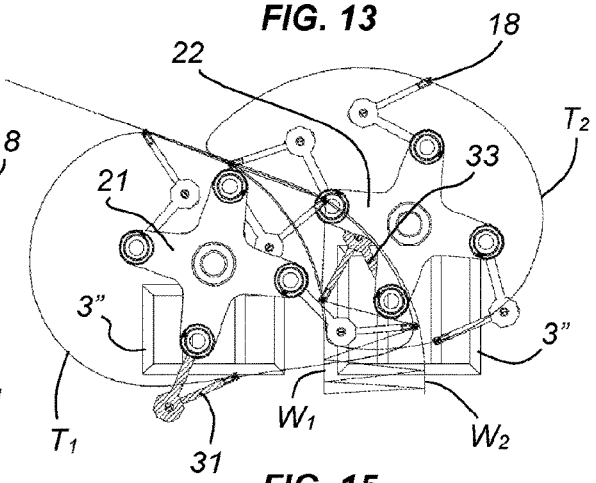
Figure 16:
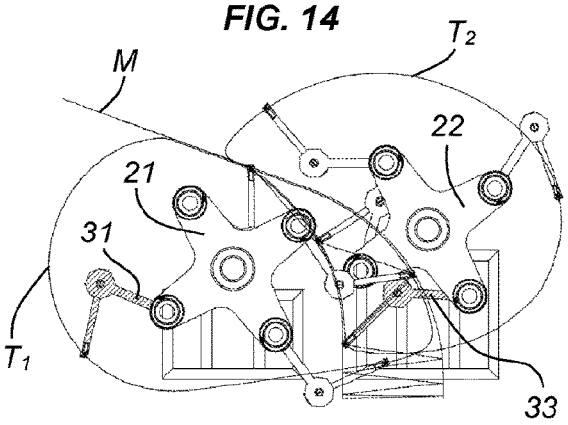
Figure 17:
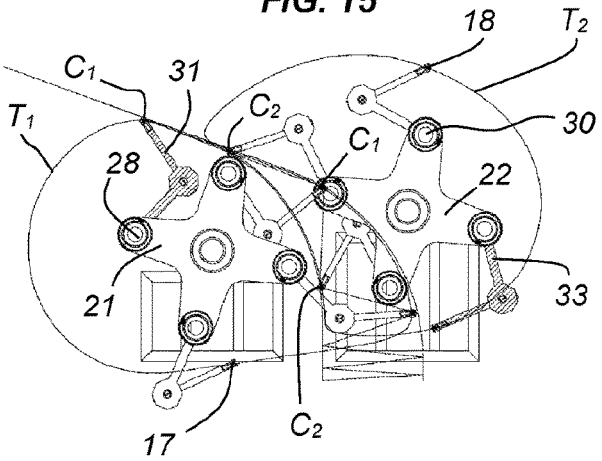
Figure 18:
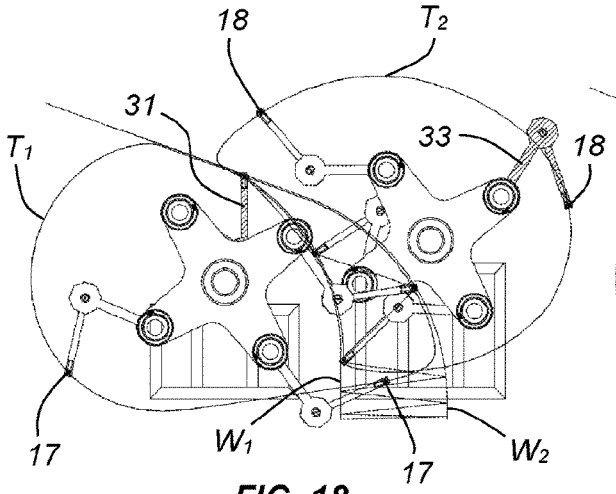
Figure 19:
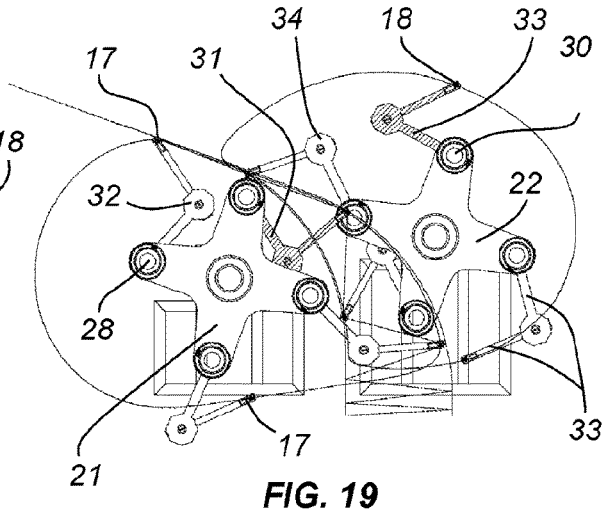

In particular, FIGS. 14 and 17 show how the thrust tools 17, 18 move away from their respective crease $C_1$, $C_2$ without interfering with the respective adjacent partitions P and only when the latter form a predetermined folding angle to prevent the weight of the continuous web M from generating press creases near the fold lines.

In a further aspect, the invention relates to a method of forming and fanfolding a sheet material, such as corrugated cardboard, from a continuous web M of indefinite length having a bottom side $S_1$, a top side $S_2$ and longitudinal side edges B.

The method comprises the steps of:

providing the device for feeding the continuous web M in a longitudinal direction L;

providing the creasing device 2 downstream of the feeding device to form transverse creases C on the continuous web M, spaced apart at a constant longitudinal pitch K and defining the adjacent partitions P;

providing the folding device 14 downstream of the creasing device 2, having at least one first group 15 of thrust tools 17 and at least one second group 16 of thrust tools 18, for progressively and alternately fanfolding the adjacent partitions P along the creases C;

forming creases $C_1$, $C_2$ by the creasing device 2, alternately on the bottom side $S_1$ and the top side $S_2$ of the continuous web M;

actuating the folding device 14 and of the tools 17, 18 of each group 15, 16 which are mechanically connected and operably dependent and move along the same trajectory $T_1$, $T_2$;

actuating the first group 15 of thrust tools 17 on the creases $C_1$ formed on the bottom side $S_1$ of the continuous web M and the second group 16 of thrust tools 18 on the creases $C_2$ formed on the top side $S_2$ of the continuous web M to avoid the formation of press creases on the continuous web M.

II will be appreciated from the foregoing that the system for forming and fanfolding a sheet material and the method according to the invention fulfill the intended objects and namely prevent the formation of press folds in the continuous web, while increasing the folding speed of the system.

The system and method of operation of the invention are susceptible to a number of changes and variants within the inventive concept as disclosed in the annexed claims.

While the system and method of operation have been described with particular reference to the accompanying figures, the numerals referred to in the disclosure and claims are only used for the sake of a better intelligibility of the invention and shall not be intended to limit the claimed scope in any manner.

Reference herein to "one embodiment" or "the embodiment" or "some embodiments" indicates that a particular characteristic, structure or element that is being described is included in at least one embodiment of the inventive subject matter.

Furthermore, the particular characteristics, structures or elements may be combined together in any suitable manner to provide one or more embodiments.

INDUSTRIAL APPLICABILITY

The present invention may find application in industry, because it can be produced on an industrial scale in factories of the sheet material processing industry.

The invention claimed is:

1. A system (1) for forming and fanfolding a sheet material from a continuous web (M) of indefinite length having a bottom side (S1), a top side (S2) and longitudinal side edges (B), the system (1) comprising:

a frame (3', 3") defining a vertical center plane (π);

a feeding device having means for guiding the continuous web (M) in a longitudinal direction (L);

a creasing device (2) located downstream of said feeding device to form transverse creases (C1, C2) on the continuous web (M) spaced apart at a constant longitudinal pitch (K) and defining adjacent partitions (P);

a folding device (14) located downstream of said creasing device (2) for progressively and alternately fanfolding the adjacent partitions (P) along the creases (C1, C2);

wherein said folding device (14) comprises at least one first group (15) of thrust tools (17) acting on the creases (C1) formed on the bottom side (S1) of the continuous web (M) and at least one second group (16) of thrust tools (18) acting on the creases (C2) formed on the top side (S2) of the continuous web (M), the thrust tools (17, 18) of each group (15, 16) being mechanically connected to and operably dependent on each other so that all the tools (17, 18) of the same group (15, 16) are forced to follow the same trajectory (T1, T2), the thrust tools (17, 18) of the same group (15, 16)

being supported at the free ends of first series (27) and second series of articulated arms (28).

2. The system as claimed in claim 1, wherein said frame (3") has mounted thereto a first operating assembly (19) for supporting and moving said first group (15) of thrust tools (17) and a second operating assembly (20) distinct from and independent of the first operating assembly (19), for supporting and moving said second group (16) of thrust tools (18).

3. The system as claimed in claim 2, wherein said first operating assembly (19) comprises a first pair of supporting wheels (21) facing each other about said vertical center plane (π) and rigidly fixed to a first transverse shaft (23) driven by a first motor (24), the wheels of said first pair (21) being located at a first transverse distance (d1) greater than the maximum width (E) of the continuous web (M).

4. The system as claimed in claim 3, wherein said second operating assembly (20) comprises a second pair of supporting wheels (22) facing each other about said vertical center plane (π) and rigidly fixed to a second transverse shaft (25) driven by a second motor (26), the wheels of said second pair (22) being located at a second transverse distance (d2) greater than said first transverse distance (d1).

5. The system as claimed in claim 4, wherein said first transverse shaft (23) and said second transverse shaft (25) are rotatably mounted to said frame (3") in longitudinally offset positions, with said second shaft (25) downstream of the first shaft (23).

6. The system as claimed in claim 3, wherein said first series of articulated arms (27) are mounted proximate to a peripheral edge (21') of said first pair of wheels (21), and are each driven by a respective first drive (28) having a transverse axis (X5) that is perpendicular to said center plane (π).

7. The system as claimed in claim 4, wherein said second series of articulated arms (29) are mounted proximate to a peripheral edge (22') of said second pair of wheels (22), and are each driven by a respective second drive (30) having a transverse axis (X6) that is perpendicular to said center plane (π).

8. The system as claimed in claim 7, wherein the articulated arms of said first series (27) are formed by respective first pairs of elongate members (31) connected to each other by third drives (32) having axes of oscillation (X7) that are transverse and perpendicular to said center plane (π), said third drives (32) being configured to impart a relative oscillation to said elongate members (31) about said transverse axes of oscillation (X7).

9. The system as claimed in claim 8, wherein the articulated arms of said second series (29) are formed by respective second pairs of elongate members (33) connected to each other by fourth drives (34) having axes of oscillation (X8) that are transverse and perpendicular to said center plane (π), said fourth drives (34) being configured to impart a relative oscillation to said elongate members (33) about said transverse axes of oscillation (X8).

10. The system as claimed in claim 9, wherein each thrust tool (17, 18) is a substantially horizontal elongate member, which is transverse and perpendicular to said center plane (π).

11. The system as claimed in claim 9, wherein said first drive (28) and second drive (30) and said third drives (32) and fourth drives (34) drives are cam type.

12. The system as claimed in claim 11, wherein said first drive (28) and second drive (30) comprise a third motor (35) and a fourth motor (36) respectively, and said third drives (32) and fourth drives (34) comprise fifth motors (37) and sixth motors (38) respectively.

13. The system as claimed in claim 12, wherein said first motor (24) and second motor (26), said third, fourth, fifth and sixth motors (35-38) are controlled by a control unit, which is able to set a first trajectory (T1) and a second trajectory (T2), which are differentiated and non-interfering trajectories, for said first group (15) and said second group (16) of thrust tools (17, 18) respectively, said control unit being able to set a first path (W1) and a second path (W2) for the creases (C1) of the bottom side (S1) and for the creases (C2) of the top side (S2) respectively.

14. The system as claimed in claim 1, wherein said creasing device (2) is configured to form creases (C1, C2) alternately on the bottom side (S1) and on the top side (S2) of the continuous web (M).

15. A method of forming and fanfolding a sheet material from a continuous web (M) of indefinite length having a bottom side (S1), a top side (S2) and longitudinal side edges (B), said method comprising:

providing a device for feeding the continuous web (M) in a longitudinal direction (L);

providing a creasing device (2) downstream of said feeding device to form transverse creases (C1, C2) on the continuous web (M), spaced apart at a constant longitudinal pitch (K) and defining adjacent partitions (P); and providing a folding device (14), as claimed in claim 1, downstream of the creasing device (2), having at least one first group (15) of thrust tools (17) and at least one second group (16) of thrust tools (18) for progressively and alternately fanfolding the adjacent partitions (P) along the creases (C1, C2);

wherein the creasing device (2) forms creases (C1, C2) alternately on the bottom side (S1) and on the top side (S2) of the continuous web (M);

wherein the first group (15) of thrust tools (17) of the folding device (14) acts on the creases (C1) formed on the bottom side (S1) of the continuous web (M) and the second group (16) of thrust tools (18) acts on the creases (C2) formed on the top side (S2) of the continuous web (M);

wherein all the tools (17, 18) of the same group (15, 16) are mechanically connected to and operably dependent on each other and move along the same trajectory (T1, T2).

* * * * *